US005339296A

United States Patent [19]

Davis

[11] Patent Number: 5,339,296

[45] Date of Patent: Aug. 16, 1994

[54] ELECTRIC ALARM CLOCK WITH BATTERY BACK-UP

[75] Inventor: Joel K. Davis, Athens, Ga.

[73] Assignee: General Time Corporation, Norcross, Ga.

[21] Appl. No.: 893,239

[22] Filed: Jun. 3, 1992

[51] Int. Cl.[5] ..... G04B 19/30

[52] U.S. Cl. ..... 368/67; 368/227; 368/64

[58] Field of Search ..... 368/64, 227, 203, 204, 368/63, 67

[56] References Cited

U.S. PATENT DOCUMENTS

| | | | |
|---|---|---|---|
| 2,875,320 | 6/1959 | Whiston | 368/227 |
| 2,895,038 | 2/1959 | Campbell | 368/227 |
| 3,136,115 | 6/1964 | Calabrese | 368/64 |
| 3,574,993 | 4/1971 | Black | 368/67 |
| 3,590,233 | 6/1971 | Protzmann | 368/227 |
| 3,922,588 | 11/1975 | Kunzel | 318/139 |
| 4,262,350 | 4/1981 | Nagashima | 368/67 |
| 4,726,002 | 2/1988 | Bitetti | 368/227 |

FOREIGN PATENT DOCUMENTS

| | | | |
|---|---|---|---|
| 0156577 | 9/1982 | Japan . | |
| 681521 | 10/1952 | United Kingdom | 368/64 |
| 2052114 | 1/1981 | United Kingdom | 368/64 |

*Primary Examiner*—Bernard Roskoski

*Attorney, Agent, or Firm*—Jones, Day, Reavis & Pogue

[57] ABSTRACT

An electric alarm clock is disclosed which operates from a conventional external AC power source but is able to continue timekeeping in the event power from the external source is interrupted. A dial illumination feature is also operable during a power failure.

4 Claims, 1 Drawing Sheet

ELECTRIC ALARM CLOCK WITH BATTERY BACK-UP

BACKGROUND OF THE INVENTION

Electric alarm clocks are commonly used in households today and besides performing general timekeeping functions, serve the very important purpose of providing a wake-up call each morning. Power outages, of course, disable a conventional electric alarm clock for the period of the outage, and the clock must be reset afterwards. Furthermore, if the outage occurs at night, the failure to provide a proper wake-up call causes a significant disruption to the household's routine.

SUMMARY OF THE INVENTION

It is an object of the present invention to provide an electric alarm clock which continues timekeeping in the event of a power failure. It is a further object to provide a dial illuminating lamp operable during a power failure.

In accordance with the present invention, an electric alarm clock comprises a dial having time indicating graphics thereon with time and alarm indicating hands mounted on the center stack of the quartz movement. A charge circuit for converting AC power from an external source to DC is provided in order to supply a DC voltage to a set of battery terminals to which may be connected a battery. A quartz alarm movement drives the time indicating hands and performs the alarm function in accordance with the position of the alarm indicating hand. The quartz movement is supplied with DC power from the battery terminals.

The alarm clock may also have a dial illuminating DC lamp for making the dial visible in the dark. The DC lamp is supplied with DC power from the battery terminals through a momentary on-off switch which is closed only when manually actuated by the user.

Other objects, features, and advantages of the invention will become evident in light of the following detailed description considered in conjunction with the referenced drawings of a preferred exemplary embodiment according to the present invention.

DETAILED DESCRIPTION OF THE INVENTION

Figure 1:
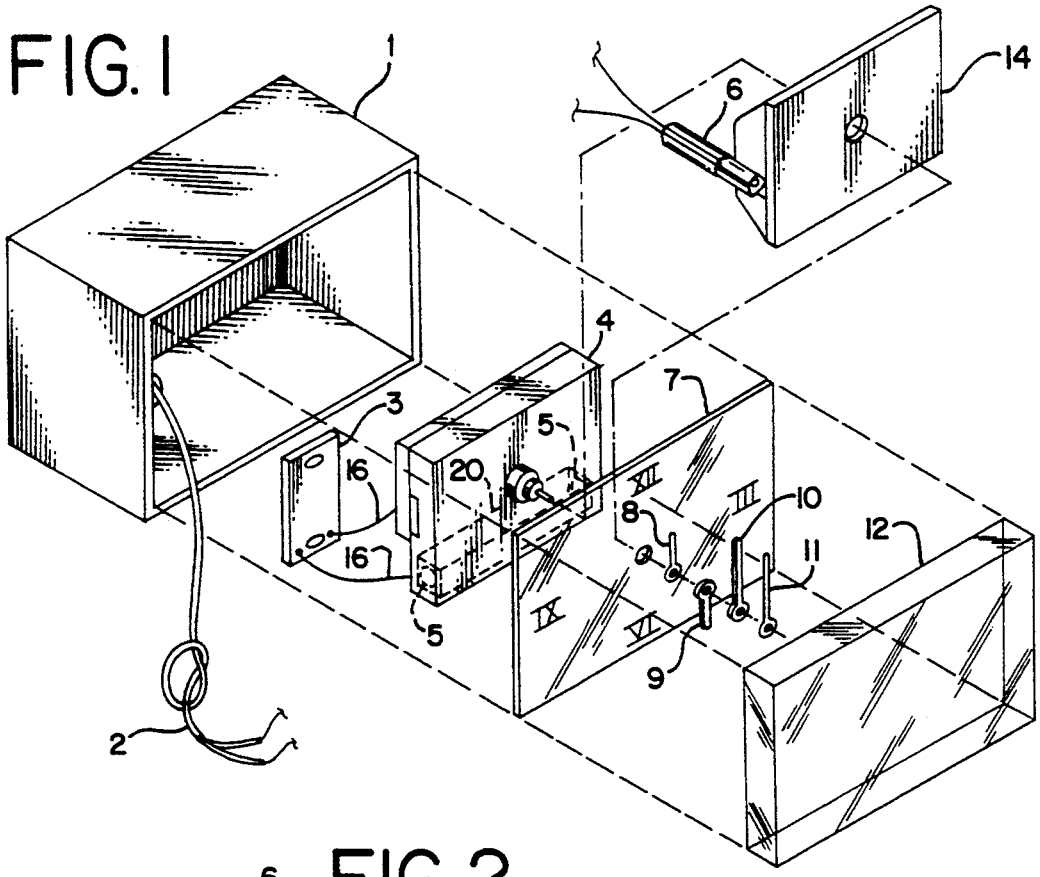
FIG. 1 is an exploded view of an electric alarm clock in accordance with the present invention.

The outer enclosure of the clock consist of a case 1 and lens 12. The case 1 can be of almost any practical material suitable for the application (injection molded polymeric material, wood, metal, etc.). The case may be a single or multi-part assembly having a painted, plated, hot stamped, or as molded finish.

The dial 7 may be made from paper, plastic, metal, etc., and have time indicating graphics that are applied to the front surface by printing, hotstamping, adhesive applique, or etc.

The lens 12 may also be made from a variety of materials such as glass, molded plastics, or cast materials. The lens normally is clear but may be tinted.

The alarm indicator 8 allows the user to select the time the alarm function is to occur and indicates the time selected by its position in relation to the dial graphics. The hour hand 9, minute hand 10, and seconds hand 11 perform the normal functions of indicating time by their relationship to the dial graphics. These hands may be made from a variety of materials such as metal, plastic, etc. Their size, color, and/or finish may be varied for identification.

Setting the time on the clock may be achieved by rotating a set knob accessible at the rear of the outer enclosure case. There may be a separate set knob for setting the time and alarm or a single knob may be used to set the time and the alarm setting. The alarm mode ON/OFF can be selected by positioning a switch accessible from the rear of the outer enclosure case into the desired mode. As part of the alarm functions, the clock may include a drowse feature that would allow the user to interrupt the alarm function and repeat alarm at a predetermined time interval.

The quartz alarm movement 4 and charge circuitry 3 are positioned and retained to the-case 1 using various mechanical means. The dial 7 is also positioned in the case 1 and may be retained by the lens 12 which can be secured to the case 1 through a snap fit feature or other means. The electric power cord 2 is connected to the charge circuitry 3 and exits the rear of the case 1.

Figure 2:
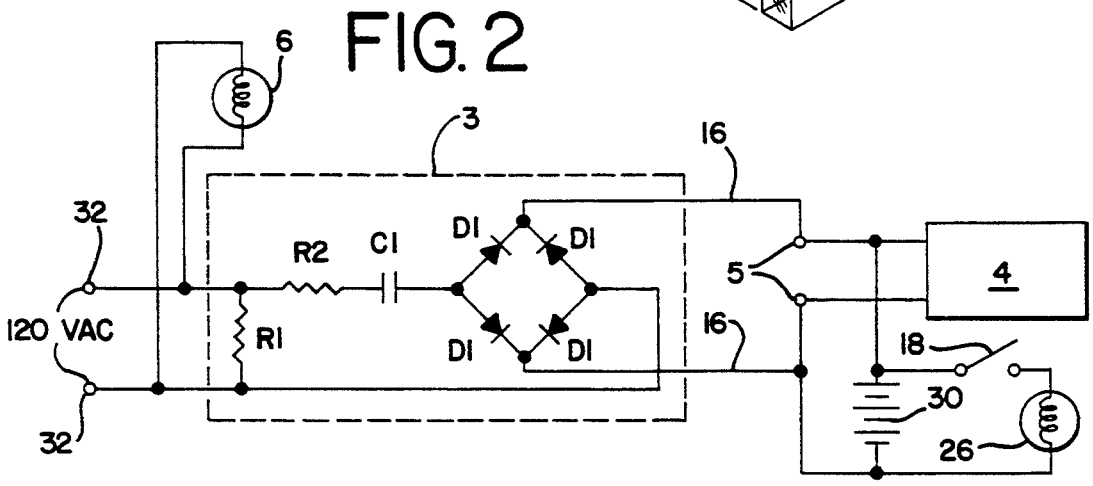
FIG. 2 is a schematic of an exemplary charging circuit.
Figure 3:
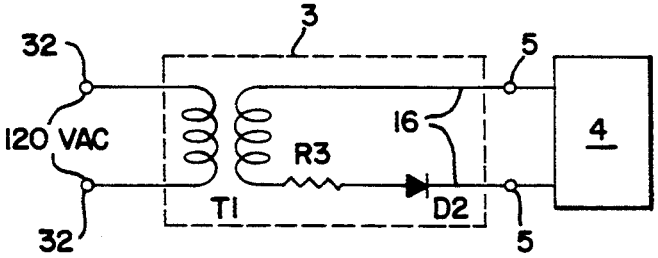
FIG. 3 is a schematic of an alternative charging circuit.

The charge circuitry 3 is typically a trickle charge circuit used to recharge rechargeable batteries 30 (see FIG. 2). Schematics of exemplary charge circuits are given in FIGS. 2 and 3. The charge circuit 3 drops and rectifies standard line current of 120 VAC at terminals 32 down to a DC level around 1.5 volts. The output of the charge circuit 3 is coupled to the battery terminals 5 and may be substantially pure DC from the circuit shown in FIG. 2 or pulsating DC from the circuit of FIG. 3, depending on the charge circuit 3 design. Wire leads 16 connect the charge circuit 3 to the battery terminals 5 which then supply power to the quartz alarm movement 4 by making proper contact with the positive and negative terminals integral to the quartz alarm movement 4.

A typical quartz alarm movement (such as a Model No. SK00603-2 manufactured by Quartex Incorporated of Lake Geneva, Wis.) requires one "AA" 1.5 VC battery such as a "AA" size nickel-cadium rechargeable battery. However, "N", "C", "D", or any other rechargeable type battery may be used if they are capable of supplying the power requirements of the quartz alarm movement 4. A battery recess 20 is provided within the quartz movement 4 into which may be inserted and connected to terminals 5 a rechargeable battery 30 such as a nickel-cadmium type. The rechargeable battery 30 is then able to supply power to the quartz movement 4 when the 120 VAC line voltage at terminals 32 is interrupted.

A molded light diffuser 14 is used to pipe and disperse the light rays from a lamp 6 such that the light rays are transmitted through a dial 7 made from translucent material thereby illuminating the dial and making it possible to see and interpret the dial and hand relationships at night. The lamp 6 used with the dial light assembly may be either incandescent or neon type and supplied by the 120 VAC. It is also practical to use an electroluminescent panel powered by 120 VAC and placed behind the translucent dial to achieve the same results. When the clock is disconnected from 120 VAC outlet, the 120 VAC powered dial lamp 6 does not function.

Figure 4:
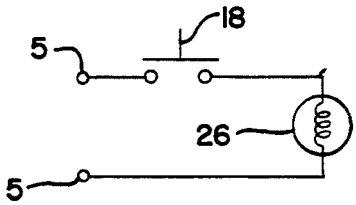
FIG. 4 is a schematic of the auxiliary D.C. dial illuminating lamp.

In order to provide dial illumination even in the event of a power failure, a D.C. lamp 26 is incorporated into the clock and supplied power from terminals 5. The physical configuration of lamp 26 is in all respects similar to lamp 6 shown in FIG. 1. In order to prevent excessively draining the battery during a power failure, the lamp 6 in this instance should be operated with a momentary ON-OFF switch 18 such as shown schematically both in FIG. 1 and FIG. 4.

Although the invention has been described in conjunction with the foregoing specific embodiment, many alternatives, variations, and modifications will be apparent to those of ordinary skill in the art. Those alternatives, variations, and modifications are intended to fall within the scope of the following appended claims.

What is claimed is:

1. An electric alarm clock comprising:

a dial made from translucent material and having graphics thereon for indicating time;

time and alarm indicating hands mounted on the dial;

a first set of terminals adapted to be connected to a rechargeable battery;

a second set of terminals adapted to be connected to an AC power source;

a charge circuit coupled to said second set of terminals for converting an AC voltage to DC voltage in order to supply a recharging voltage to a battery connected to the first set of terminals;

a quartz alarm movement supplied with DC power from the first set of terminals for driving the time indicating hands and performing an alarm function in accordance with the position of the alarm indicating hand;

a dial illuminating DC lamp;

a momentary ON-OFF switch coupling the first set of terminals to the DC lamp such that the DC lamp receives power from a rechargeable battery connected to the first set of terminals only when the switch is actuated;

an AC lamp coupled to said second set of terminals for illuminating the dial only when supplied with power from said second set of terminals; and a molded light diffuser mounted behind said dial for piping and disbursing light rays from the AC and DC lamps through the dial.

2. The electric alarm clock as set forth in claim 1 further comprising a nickel-cadmium battery connected to the first set of terminals to be recharged by the charge circuit.

3. An electric alarm clock comprising:

a dial made from translucent material and having graphics thereon for indicating time;

time and alarm indicating hands mounted on the dial;

a first set of terminals adapted to be connected to a rechargeable battery;

a second set of terminals adapted to be connected to an AC power source;

a charge circuit coupled to said second set of terminals for converting an AC voltage to DC voltage in order to supply a recharging voltage to a battery connected to the first set of battery terminals;

a quartz alarm movement supplied with DC power from the first set of terminals for driving the time indicating hands and performing an alarm function in accordance with the position of the alarm indicating hand;

a dial illuminating DC lamp;

a momentary ON-OFF switch coupling the first set of terminals to the DC lamp such that the DC lamp receives power from a rechargeable battery connected to the first set of terminals only when the switch is actuated;

an AC lamp coupled to the second set of terminals for illuminating the dial only when supplied with power from said second set of terminals; and a electroluminescent panel behind said dial for illuminating the dial with the AC and DC lamps.

4. The electric alarm clock as set forth in claim 3 further comprising a nickel-cadmium battery connected to the first set of terminals to be recharged by the charge circuit.

* * * * *